US005136331A

United States Patent [19]

Gracie

[11] Patent Number: 5,136,331

[45] Date of Patent: Aug. 4, 1992

[54] DEVICE FOR COPYING CURLED DOCUMENTS

[76] Inventor: James A. Gracie, 512 Sterner Mill Rd., Feasterville, Pa. 19053

[21] Appl. No.: 683,766

[22] Filed: Apr. 10, 1991

[51] Int. Cl.[5] ..... G03G 21/00

[52] U.S. Cl. ..... 355/202; 248/251; 355/75; 355/133

[58] Field of Search ..... 355/230, 231, 75, 133, 355/200, 202; 162/270, 271; 40/341, 352, 357; 248/206.5, 442.2, 451

[56] References Cited

U.S. PATENT DOCUMENTS

| | | | |
|---|---|---|---|
| 2,774,289 | 12/1956 | Collins | 355/75 |
| 4,137,863 | 2/1979 | Anglin | 40/352 X |
| 4,231,174 | 11/1980 | Thompson | 40/341 X |
| 4,727,400 | 2/1988 | Ito | 355/75 |
| 4,882,603 | 11/1989 | Sakata | 355/75 |

*Primary Examiner*—A. T. Grimley
*Assistant Examiner*—J. E. Barlow, Jr.

[57] ABSTRACT

A device for flattening curled or crumpled documents for copying on a photocopier is disclosed. The device includes a flat surface with lifting tabs and magnets attached thereto. The device is placed on top of the document which has been positioned face down on the transparent surface of the copier. The device straightens curled documents. For crumpled or wrinkled documents, when the hinged cover is closed, the device presses down on the document straightening out the curled or crumpled document so that it may be copied easily and cleanly. When the device is not in use, the magnets attached to the device enable the device to be stored by attaching it to the sides of the copier, or a file cabinet or stand.

3 Claims, 2 Drawing Sheets

FIG. 2
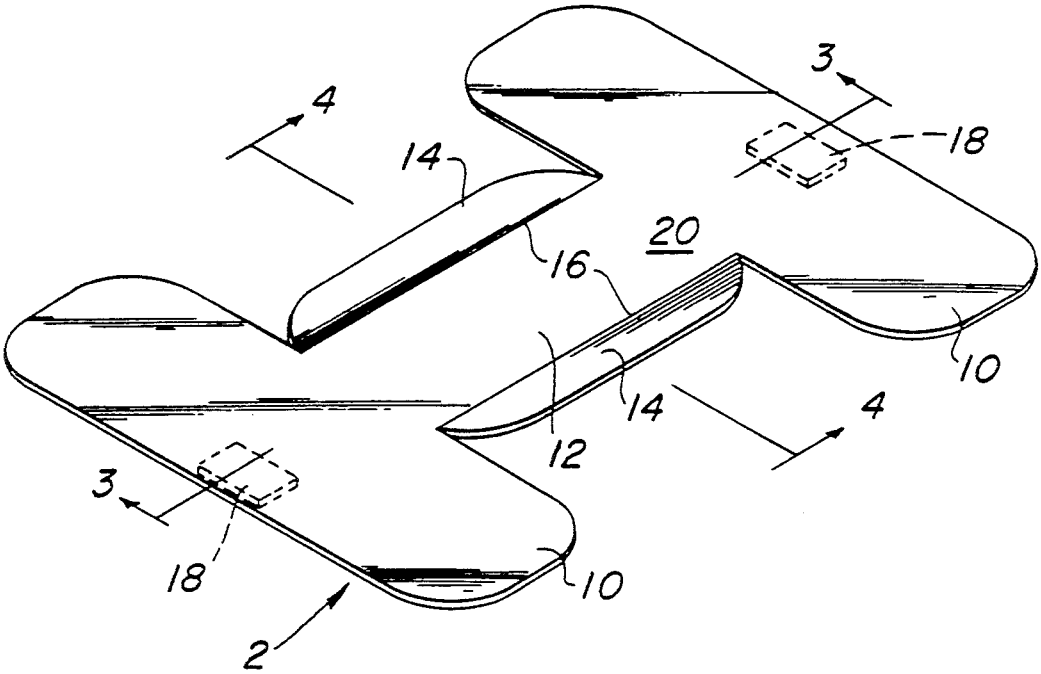
FIG. 3
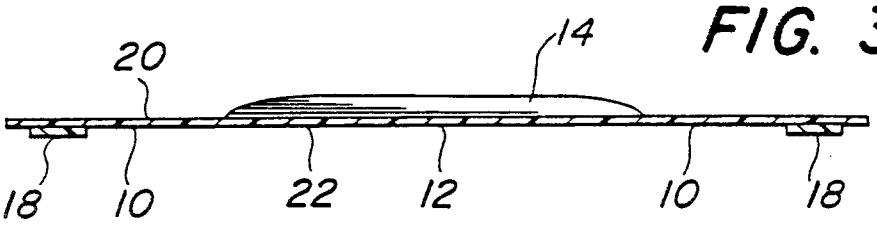
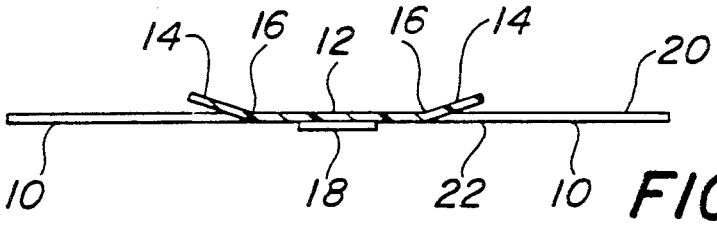
FIG. 4

DEVICE FOR COPYING CURLED DOCUMENTS

BACKGROUND OF THE INVENTION

This invention relates generally to a device for flattening curled or crumpled documents and in particular to a device for flattening curled or crumpled documents to be used with a copier.

The paper used in many facsimile machines tends to curl after a facsimile has been made. The paper often curls from side-to-side and at the end of the rolls the paper will tend to curl from end to end.

This makes copying the documents on standard photocopying machines difficult since the document must be placed flat on a transparent surface, with the hinged cover closed on the document. Curled documents tend to bend and be folded so that clean copies are difficult to obtain.

Furthermore, some documents, with age or handling tend to be crumpled or wrinkled and not straight. When the surface of the document is crumpled, the output of the copying machine is not consistent with certain areas being lighter than others.

In view of the above, there is a need for a device to assure that curled or crumpled documents can be easily and effectively copied on photocopy machines.

OBJECT OF THE INVENTION

Accordingly, it is a general object of this instant invention to provide a device for flattening documents for copying on photocopy machines.

It is a further object of the instant invention to provide a device for flattening documents for copying which has a means to provide for easy lifting and handling of the device.

It is still a further object of the instant invention to provide a device for flattening documents for copying which can be easily stored when not in use.

It is still yet a further object of the instant invention to provide a device for flattening documents for copying which can be easily stored on the side of the copier when the device is not in use.

It is an additional object of the instant invention to provide a device for flattening documents for copying which is unitary in construction and is easy and inexpensive to manufacture.

SUMMARY OF THE INVENTION

These and other objects of the instant invention are achieved by providing a flat member which can be placed atop a curled or crumpled document while copying. The device straightens curled documents. For badly crumpled or wrinkled documents, when the hinged cover of the photocopier is closed down upon the device, the device presses upon the document straightening it out. The device includes tabs for easy lifting and handling. Magnets are attached to the device so that it can be stored on the sides of the copier when not in use.

DESCRIPTION OF THE DRAWING

Other objects and many of the attendant advantages of the instant invention will be readily appreciated when the same becomes better understood by reference to the following detailed description, when considered in connection with the accompanying drawing wherein:

FIG. 2 is a perspective view of the device of the instant invention.

FIG. 3 is a sectional view of the device of the instant invention taken along the line 3—3 of FIG. 2.

FIG. 4 is a sectional view of the instant invention taken along the line 4—4 of the FIG. 2.

DETAILED DESCRIPTION OF THE PREFERRED EMBODIMENT

Figure 1:
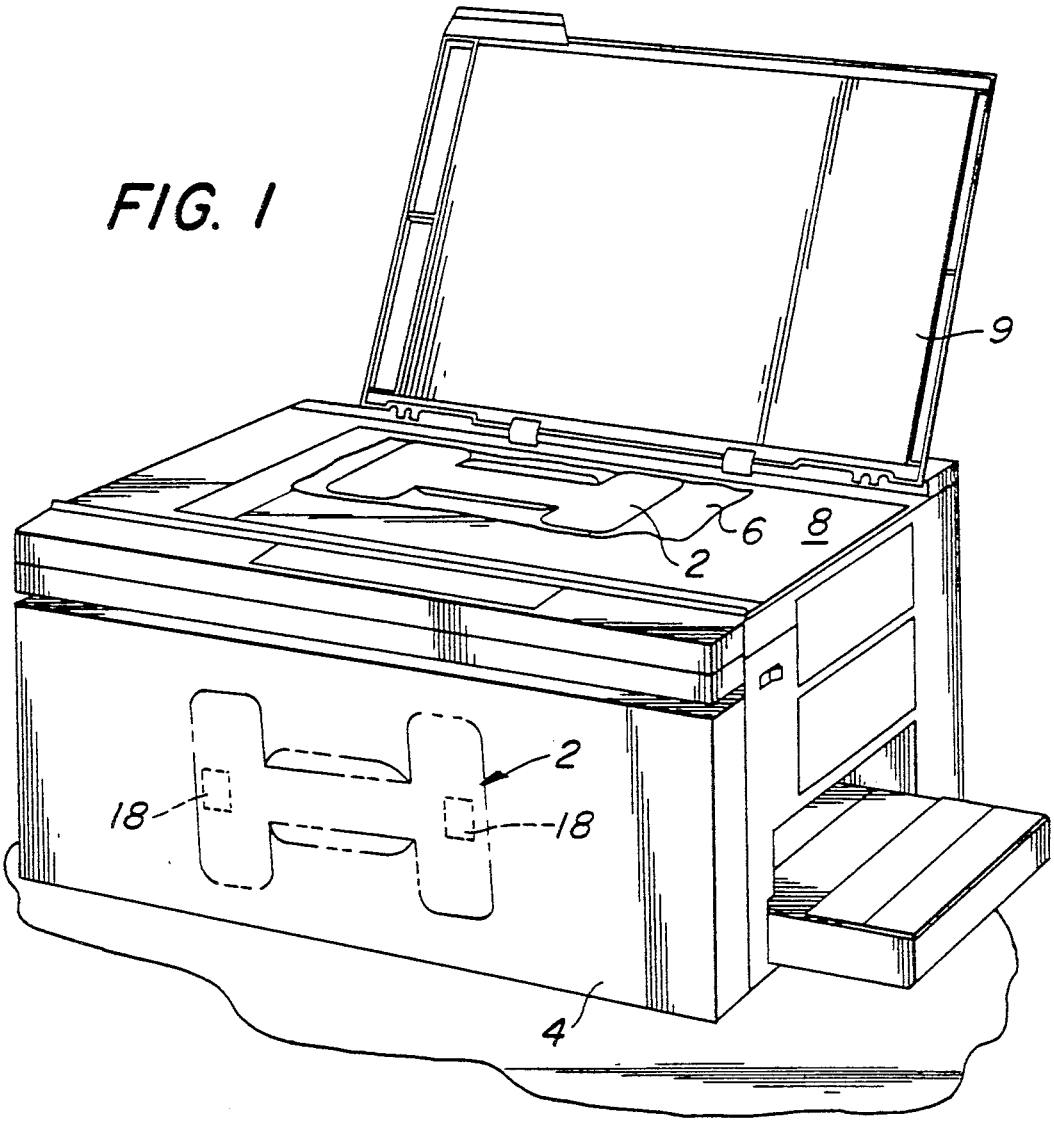
FIG. 1 is a perspective view drawing of the device placed atop a curled document on a photocopier.

Referring now in greater detail to the various figures of the drawing, wherein like reference characters refer to like parts, there is shown in FIG. 1 a perspective view of the device 2 of the invention in use with a photocopier 4. A crumpled or curled document 6 is placed face down on the transparent surface 8 of the copier 4 for copying. The device 2 is placed atop the document 6. The device flattens curled paper. For badly crumpled or wrinkled documents, when the hinged cover 9 of the photocopier 4 is closed it presses on the device 2, which flattens the document 6 for copying. Also shown in FIG. 1, in dashed lines, is the device 2 as stored when not in use. The storage of the device will be explained in detail later.

The cross members 10 are made sufficiently wide to cover the document being copied, but the longitudinal number 12 is made narrower to facilitate ease of handling of the device 2. The narrowing of the longitudinal number 12 also allows for proper alignment of the document 6 after it is in place beneath the device 2.

As can be seen in FIG. 2, the device 2 comprises cross-members 10 connected by a longitudinal member 12. The device 2 is of unitary construction with score lines 16 scribed in the longitudinal member 12. Tabs 14 are bent upward at the score line so that the planes of the tabs 14 are at an angle to the plane of the flat upper surface 20 of the device 2, as can be seen in FIGS. 2–4. Setting the tabs 14 at an angle to the surface 20 of the device 2 enables the easy lifting and handling of the device. However, when the hinged cover 9 is closed, the pressure applied temporarily forces the tabs 14 down so that they are even with surface 20.

The device 2 not only flattens documents but it also prevents documents from shifting prior to copying. This shifting is caused by air drafts created by closing of the lid 9 which tends to make light documents move.

Magnets 18 are attached to the lower surface 22 of the device 2. The magnets 18 enable the device 2 to adhere to the sides of the photocopier 4 for easy and convenient storage of the device 2 when it is not in use. If the photocopier sides are non-magnetic, the sides of a nearby file cabinet, or of the stand on which the photocopier 4 is placed, may be used for storing the device 2.

The device 2 can be manufactured of a high density polyethylene material which is formed using die cut plates. This enables the device to be easy and inexpensive to manufacture, and to be light for easy handling and storing.

Without further elaboration, the foregoing will so fully illustrate my invention that others may, by applying current or future knowledge, readily adapt the same for use under various conditions of service.

I claim:

1. A device for use with a copier having a hinged cover and a transparent copying surface, said device comprising: a means for flattening curled or crumpled documents to be copied; a means for lifting said device;

and a means for storing said device when not in use; wherein said means for flattening said document comprises a flat surface portion so that when said document is placed on said copying surface with the information to be copied face down, and said flat surface portion is placed atop said document, said curled documents are flattened, and when said hinged cover is closed, said hinged cover presses downward on said flat surface portion, said crumpled documents are flattened, wherein said means for lifting said device further comprises at least one tab attached to said device which is at an angle to the plane of said flat surface portion, said at least one tab being pressed flat when said hinged cover is closed, and wherein said device further comprises two cross members with a longitudinal member connecting said cross members and said at least one tab is connected to said longitudinal member.

2. The device of claim 1 wherein said device is unitary in construction and has at least one score line in said longitudinal member, and said at least one tab is formed by bending a part of said longitudinal member upward along said at least one score line so that the plane of said bent part is at angle to the plane of said longitudinal member.

3. The device of claim 2 wherein said device has a second surface and said means for storing said device comprises at least one magnet attached to said second surface for attaching said device to the side of said copier, or to a file cabinet or stand when said device is not in use.

* * * * *